US007219895B1

(12) United States Patent
Hutchins, Jr.

(10) Patent No.: US 7,219,895 B1
(45) Date of Patent: May 22, 2007

(54) CHESS GAME PLAYING ARRAY ASSEMBLY

(76) Inventor: Robert H. Hutchins, Jr., 101 Hall Ave., Opelika, AL (US) 36804

( * ) Notice: Subject to any disclaimer, the term of this patent is extended or adjusted under 35 U.S.C. 154(b) by 472 days.

(21) Appl. No.: 09/591,112

(22) Filed: Jun. 9, 2000

(51) Int. Cl.
*A63F 3/00* (2006.01)

(52) U.S. Cl. ..... 273/261; 273/236

(58) Field of Classification Search ..... 273/236, 273/287, 258, 260, 261, 237, 241, 276, 281, 273/282.1, 282.2, 283, 284; D21/348, 388
See application file for complete search history.

(56) References Cited

U.S. PATENT DOCUMENTS

| | | | | | |
|---|---|---|---|---|---|
| 511,306 | A | * | 12/1893 | Moore | 273/261 |
| 1,578,554 | A | * | 3/1926 | Seligman | 273/153 R |
| 2,946,592 | A | * | 7/1960 | Post | 273/290 |
| 3,406,975 | A | * | 10/1968 | Berger | |
| D221,390 | S | * | 8/1971 | Skillman | |
| D223,939 | S | * | 6/1972 | Palazzolo | |
| 3,734,505 | A | * | 5/1973 | Germanis | 273/278 |
| D228,775 | S | * | 10/1973 | Randell | |
| 3,767,201 | A | | 10/1973 | Harper et al. | |
| 3,871,657 | A | | 3/1975 | Lorenz et al. | |
| 4,045,030 | A | | 8/1977 | Strozewski | |
| 4,083,564 | A | * | 4/1978 | Matsumoto | 273/239 |
| 4,133,537 | A | | 1/1979 | Chappell | |
| D251,322 | S | | 3/1979 | Weiss | |
| 4,147,362 | A | | 4/1979 | Fisher | |
| D252,713 | S | | 8/1979 | Weiss | |
| 4,179,127 | A | | 12/1979 | Goodman | |
| 4,305,585 | A | * | 12/1981 | Flynn | |
| D272,373 | S | | 1/1984 | Kowal | |
| 4,647,049 | A | * | 3/1987 | Oretsky | |
| 4,696,476 | A | * | 9/1987 | Eplett | |
| 4,778,187 | A | | 10/1988 | Deak, Jr. | |
| 4,927,157 | A | | 5/1990 | Riihiluoma et al. | |
| 5,011,159 | A | | 4/1991 | Fortunato et al. | |
| D349,521 | S | | 8/1994 | Harris, III, et al. | |
| 5,333,878 | A | * | 8/1994 | Calhoun | 273/283 |
| 5,358,252 | A | | 10/1994 | McPhaul | |
| D363,091 | S | | 10/1995 | Dobis | |
| 5,462,281 | A | * | 10/1995 | Gaito | |
| 5,464,224 | A | * | 11/1995 | Rosenbaum | |

(Continued)

FOREIGN PATENT DOCUMENTS

DE 004135598 A1 * 5/1993

(Continued)

OTHER PUBLICATIONS

Geo Chess, admitted prior art, Internet web page.

(Continued)

*Primary Examiner*—Vishu K. Mendiratta
(74) *Attorney, Agent, or Firm*—Renner, Otto, Boisselle & Sklar, LLP

(57) ABSTRACT

A chess game playing array assembly including a plurality of three-dimensional playing segments is disclosed. The playing segments are disposed relative to one another to define an array of playing spaces on which a game of chess may be played. One or more of the plurality of three dimensional playing segments may be spaced apart by one or more voids or in abutting relation with one another.

9 Claims, 10 Drawing Sheets

U.S. PATENT DOCUMENTS

| | | | | |
|---|---|---|---|---|
| D371,166 | S | 6/1996 | Furlong | |
| D374,688 | S | 10/1996 | Furlong | |
| D388,129 | S | 12/1997 | Lampel | |
| D402,709 | S | 12/1998 | Colebank | |
| 5,868,388 | A * | 2/1999 | Wood et al. | |
| D407,124 | S | 3/1999 | Melander | |
| 5,913,517 | A * | 6/1999 | Gaffney et al. | 273/241 |
| 6,257,575 | B1 * | 7/2001 | Ortega | |
| 6,279,907 | B1 * | 8/2001 | Hullinger | |

FOREIGN PATENT DOCUMENTS

GB 2229099 A * 9/1990

OTHER PUBLICATIONS

Round Chess, 1996, 97, 98, Internet web page.
Four Player Chess (rendition a) . . . , 1996, 97, 98, Internet web page.
Three Player Chess (rendition a) . . . , admitted prior art, Internet web page.
Three Player Chess (rendition b) . . . , admitted prior art, Internet web page.
Balbo's chess, 1974, Internet web page.
8×8 Heart Chess, Jan. 13, 1998, Internet web page.
Photo's of Infinite Chess, admitted prior art, Internet web page.
8×8 Hyperbolic Chess, Jun. 30, 1997, Internet web page.
Knot Chess, admitted prior art, Internet web page.
Missoum 8×8 Spider Web Spiral Chess, Jun. 30, 1997, Internet web page.
Missoum Perspective Chess, admitted prior art, Internet web page.
Steps Chess, May 20, 1997, Internet web page.
3D 4 Cubed Chess, admitted prior art, Internet web page.
Pyramid Chess, 1998, Internet web page.
HexiChess, admitted prior art, Internet web page.
Link to: 3D-Schach, May 7, 1997, Internet web page.
8×8 Reversible Stairs—Chess, admitted prior art, Internet web page.
Three Dimensional Circular Perspective Chess, admitted prior art, Internet web page.

* cited by examiner

CHESS GAME PLAYING ARRAY ASSEMBLY

FIELD OF THE INVENTION

The present invention relates generally to a chess game playing array assembly and more particularly to a chess game playing array assembly having multiple playing segments forming playing spaces on which a game of chess may be played.

BACKGROUND OF THE INVENTION

The game of chess has maintained its popularity for centuries. Numerous ornamental designs of the chess game playing pieces, specifically, the king, queen, bishop, knight, rook and pawn, have added to this popularity. However, although the playing pieces have been regularly redesigned, the chess board on which the game of chess is played has remained substantially the same, even in the internet's electronic gaming environments. Previous attempts have been made to redesign the chess board. These include, for example, three dimensional versions of the chess board, provisions for additional players, variations in the playing surface of the chess board, for example, landscape chess boards, and modifications to the actual game of play, for example, a chess board having a figure eight array of playing spaces.

The applicant recognized a need for a chess game playing assembly which would provide improved flexibility for arranging and/or designing various three dimensional chess game playing arrays.

SUMMARY OF THE INVENTION

The present invention provides a chess game playing array assembly including plural three dimensional playing segments disposed relative to one another to form a chess game playing array. According to a general aspect of the invention, the multiple three dimensional playing segments may be arranged and/or individually designed to form an unlimited number of playing array assemblies embodying one or more themes or motifs.

According to an aspect of the invention, there is provided a chess game playing array assembly including a plurality of three-dimensional playing segments disposed relative to one another to define an array of playing spaces on which a game of chess may be played, the plurality of three dimensional playing segments being spaced apart by one or more voids.

In one embodiment, each of the plurality of three dimensional playing segments defines a playing space of the array of playing spaces although any particular playing segment may define two or more playing spaces. A playing segment may have a size different from that of another of the playing segments.

In another embodiment, the plurality of three dimensional playing segments comprises 64 playing segments defining, respectively, 64 playing spaces. Preferably, the playing segments are disposed relative to one another to define an array of 64 playing spaces consisting of eight rows and eight columns and the playing segments in the corners of the 64 space playing array have a height greater than the heights of the other playing segments.

In yet another embodiment, the plurality of three dimensional playing segments form a rectangular shape graduated array and include corner playing segments having a first elevation, middle playing segments having a second elevation, and intermediate playing segments having an elevation intermediate to that of the first elevation and second elevation. The first elevation may be higher or lower than the second elevation to achieve the graduated array.

In another embodiment, the spacing between the respective plurality of three dimensional playing segments is substantially uniform.

In regard to the three dimensional playing segments, in one embodiment, a three dimensional playing segment includes a bottom wall, a top wall and a column which connects and extends between the bottom wall and top wall. In another embodiment, at least one of the three dimensional playing segments includes a prescribed pattern located, for example, on one of its sides. An interior region may be provided in a three dimensional playing segment which may be sized to receive therein one or more playing pieces of a chess game. Also, or alternatively, the interior region may house a lighting element. To this end, a wall of the playing segment may be transparent or translucent to permit light from the lighting element to pass therethrough. Also, one or more of the walls may be transparent or translucent to enable viewing of the interior region, for example, prescribed patterns on the inside walls of the playing segment, or objects housed in the interior region.

In another embodiment, one or more void fillers may be disposed in one or more of the voids. A void filler may include an upstanding wall separating adjacently disposed playing segments.

In yet another embodiment, the plurality of three dimensional playing segments includes first and second opposing playing segments. Each playing segment defines a four row by eight column array of playing spaces such that when disposed relative to one another an eight row by eight column array of playing spaces is formed. The first playing segment includes a different motif than that of the second playing segment.

In another embodiment, the chess game playing array assembly is displayed on a display as a graphical user interface. Also, a logic stored by a memory and processed by a processor may be used to display an image of the chess game playing array assembly on a display. The logic stored in memory may include a computer program adapted to receive design parameter inputs. The design parameter inputs may include a respective size and shape of the three dimensional playing segments, a desired number of playing segments, a desired number of playing spaces provided by the respective quantity of playing segments, an arrangement of the playing segments and a respective size and shape of the voids.

According to another aspect of the invention, there is provided a chess game playing array assembly including a plurality of three-dimensional playing segments disposed relative to one another to define an array of playing spaces on which a game of chess may be played, wherein at least one of the playing segments includes a motif different from that of another of the playing segments.

In one embodiment, the plurality of three dimensional playing segments include first and second opposing playing segments, wherein the first playing segment includes a different motif than that of the second playing segment. Each of the first and second playing segments may define, for example, a four row by eight column array of playing spaces such that when disposed relative to one another collectively an eight row by eight column array of playing spaces is formed. Also, the first and second segments may be disposed in opposing abutting relation or in spaced apart relation. Still further, the first and second segments may be sloped, for example, from an outer portion to a portion at which the playing segments oppose each other.

According to yet another aspect of the invention, there is provided a chess game playing array assembly including first, second and third three dimensional playing segments disposed relative to one another to define an array of playing spaces on which a game of chess may be played, the first and second playing segments each defining a two row by eight column array of playing spaces, and the third playing segment defining a four row by eight column array of playing spaces. The third playing segment is disposed between the first and second playing segments to form an eight row by eight column array of playing spaces.

In one embodiment, the first playing segment includes a different motif than that of the second playing segment. For a traditional chess game the first playing segment forms the original starting positions for a first chess player's pieces and the second playing segment forms the original starting positions of a second chess player's pieces.

The foregoing and other features of the invention are hereinafter more fully described and particularly pointed out in the claims, the following description and the annexed drawings setting forth in detail one or more illustrative embodiments of the invention, such being indicative, however, of but several of the various ways in which the principles of the invention may be employed.

DETAILED DESCRIPTION

Figure 1:
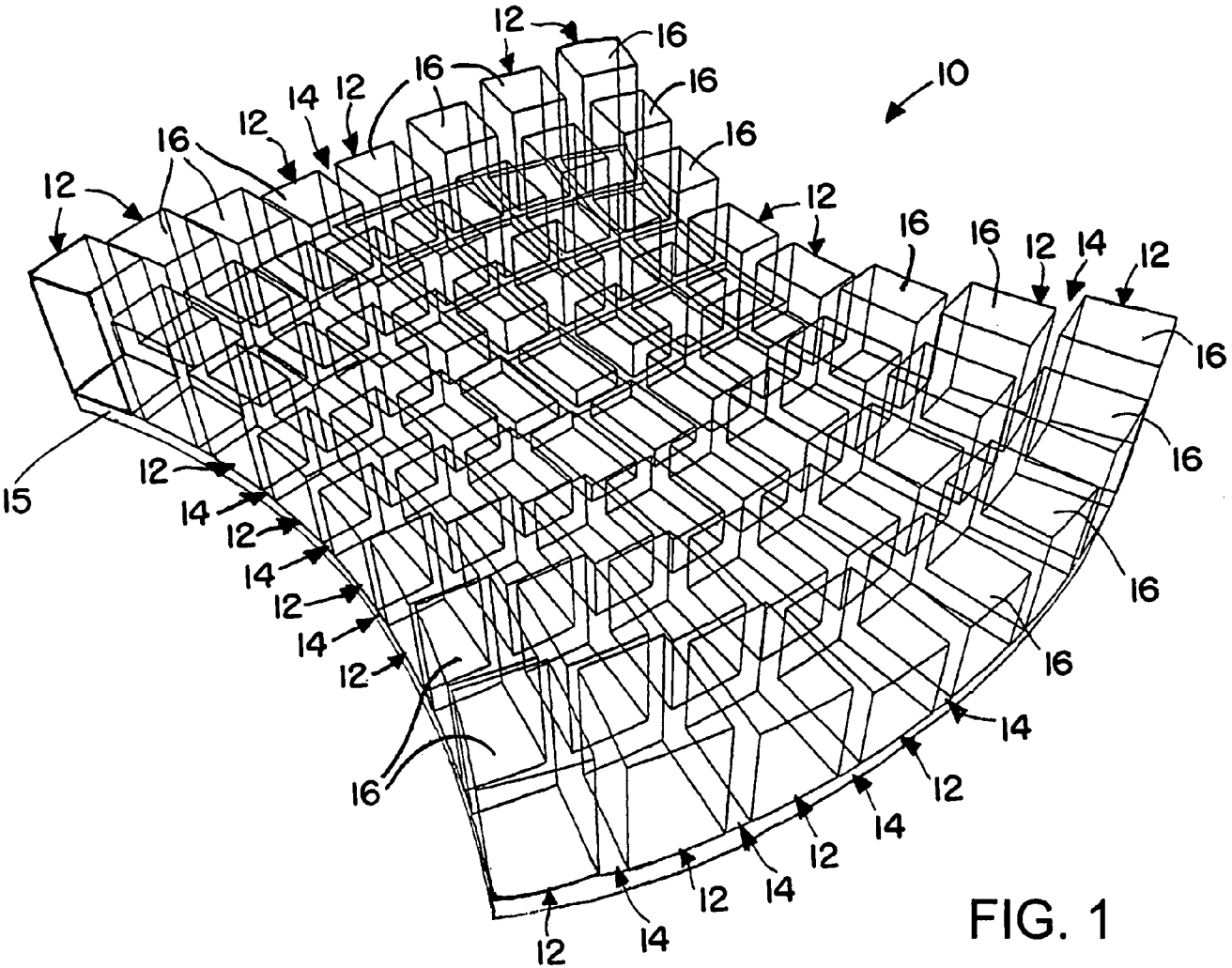
FIG. 1 is a schematic perspective view of one embodiment of a chess game playing array assembly in accordance with the present invention.
Figure 2:
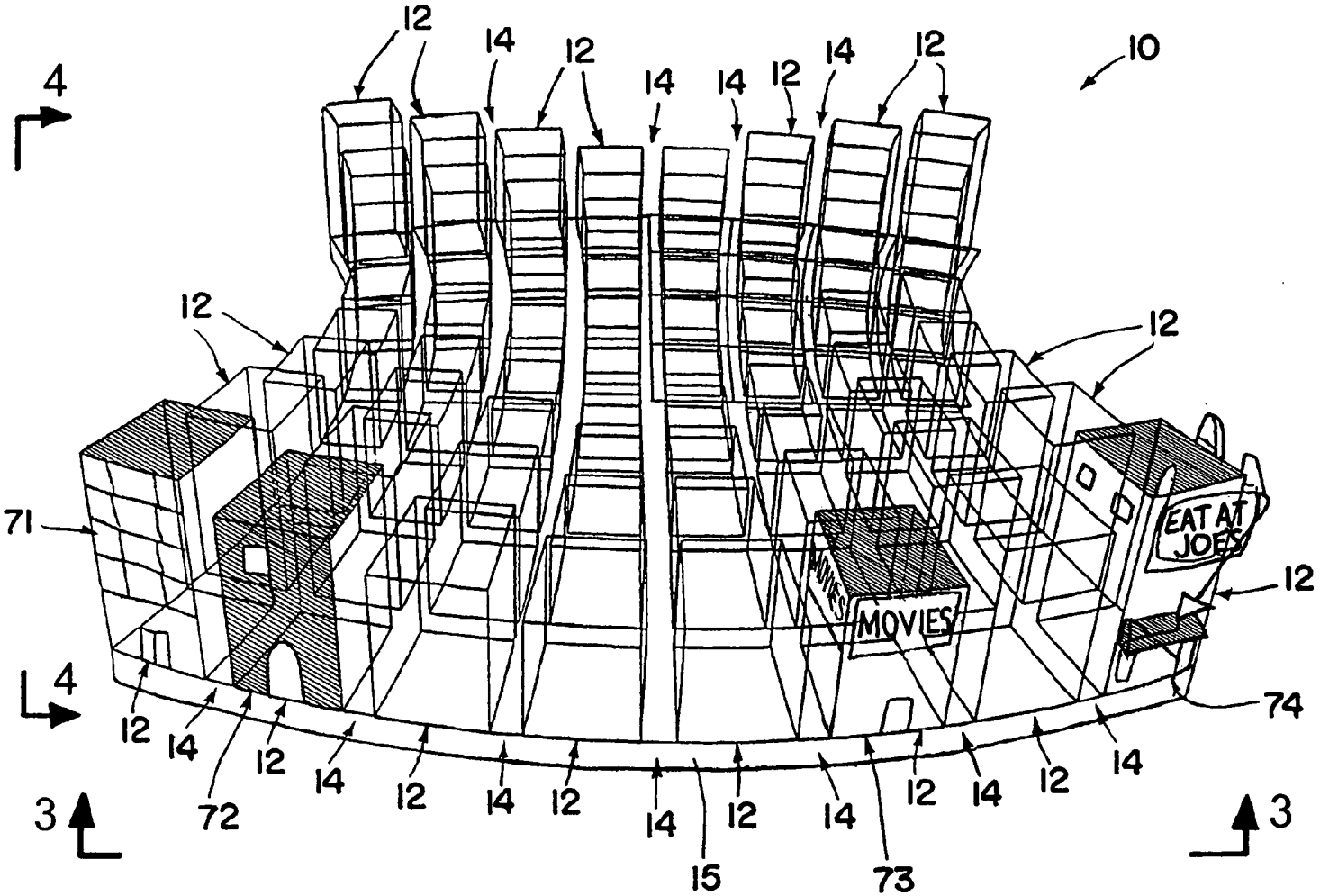
FIG. 2 is a front perspective view of the chess game playing array assembly of FIG. 1.

Referring now to the drawings in detail and initially to FIGS. 1 and 2, a chess game playing array assembly 10 according to the present invention is shown. The chess game playing array assembly 10 includes a plurality of three-dimensional playing segments 12 spaced apart by voids 14. The playing segments 12 are preferably mounted on a base 15 and are positioned relative to one another to define a playing array or grid on which a game of chess may be played. To this end, each playing segment 12 preferably includes one or more playing spaces 16 which form a portion of the playing array. In the illustrated embodiment, each playing segment 12 has a single playing space 16 (FIG. 5) and the arrangement thereof forms a traditional chess game playing array; i.e., there are 64 playing segments 12 providing, respectively, 64 playing spaces 16, the playing segments 12 being arranged in an eight row by eight column fashion.

Figure 3:
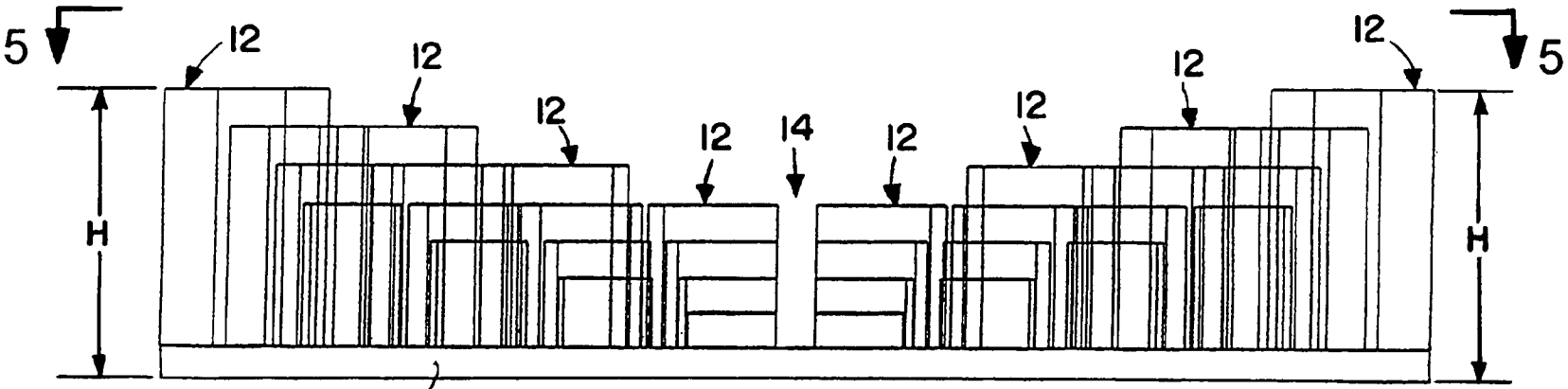
FIG. 3 is a front elevation view of the chess game playing array assembly of FIG. 1 as seen from the line 3—3 in FIG. 2.
Figure 4:
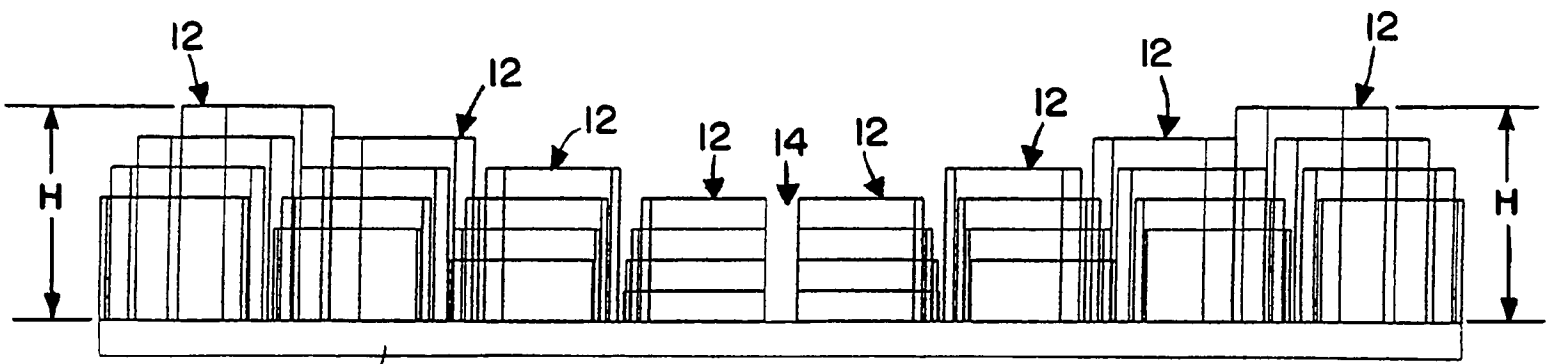
FIG. 4 is a side elevation view of the chess game playing array assembly of FIG. 1 as seen from the line 4—4 in FIG. 2.
Figure 5:
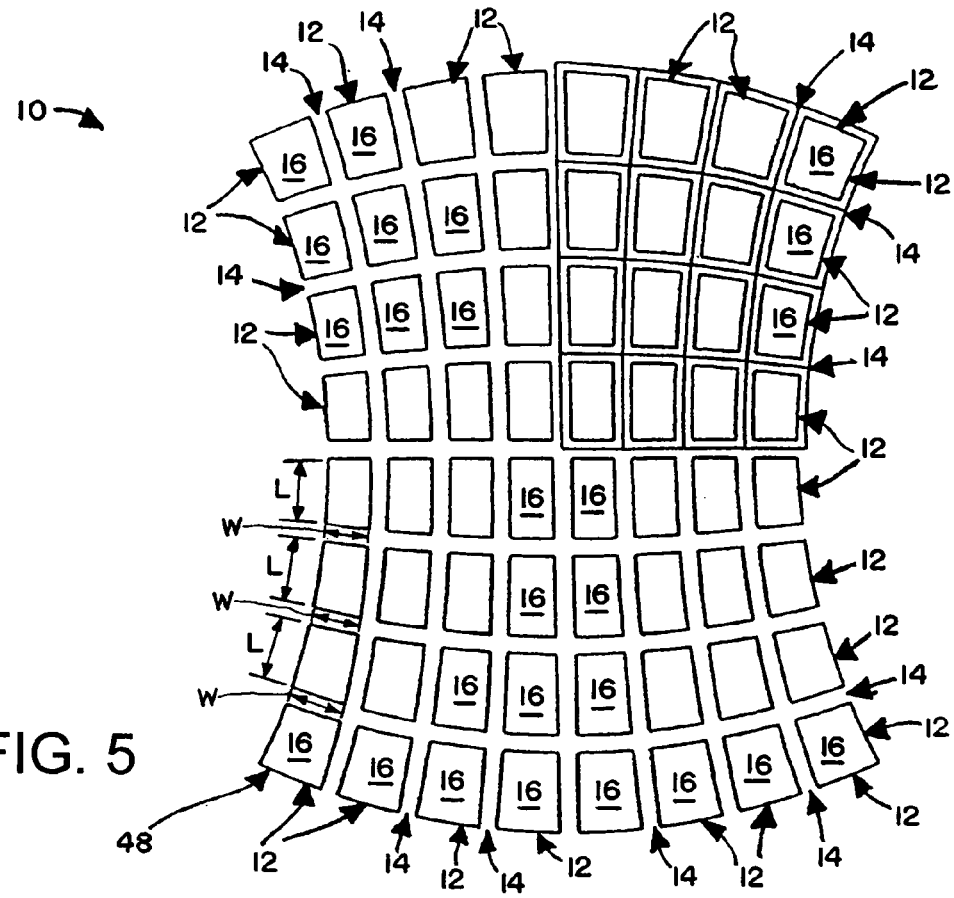
FIG. 5 is a top plan view of the chess game playing array assembly of FIG. 1 as seen from the line 5—5 in FIG. 3.

It will be appreciated that the independent construction of the plurality of three dimensional playing segments 12 enables the playing segments 12 to be sized, dimensioned or otherwise altered to achieve any desirable design or motif. For example, as is shown in FIGS. 3 and 4, the height H of the corner playing segments 12 (that is, the playing segments on which the Rook playing pieces are originally positioned in a traditional chess game) is greater than the height of any of the intermediate playing segments 12. Also, as is shown in FIG. 5, the lengths L of the respective playing segments 12 are generally greater than the widths W thereof. More particularly, the playing segments 12 form a graduated chess game playing array assembly 10 wherein the corner playing segments 12 have the highest elevation, the middle playing segments 12 have the lowest elevation, and the intermediate playing segments 12 are gradually stepped downward in elevation from the outer playing segments 12 to the middle playing segments 12. In addition, the playing segments 12 are preferably uniformly spaced apart. Further, the perimeter of the playing array assembly 10 may include arcuate edges which are generally convex in the width direction and generally concave in the length direction, as illustrated in the embodiment shown in FIGS. 1–5.

It will be appreciated that the plurality of three dimensional playing segments 12 enables flexibility in arranging and designing any number of various chess game playing array assemblies while keeping with the manner in which the game of chess is played. For example, in the chess game playing array assembly of FIGS. 1–5, the arrangement of the playing segments 12 forms a stadium motif while continuing to support the linear visual nature in the rows, columns and diagonals of the array. In other words, the functional aspect of the game, that is, the ability to make lateral (left to right), longitudinal (forward and backward), diagonal or L-shape movements characteristic of the traditional chess game playing pieces is preserved.

Figure 6:
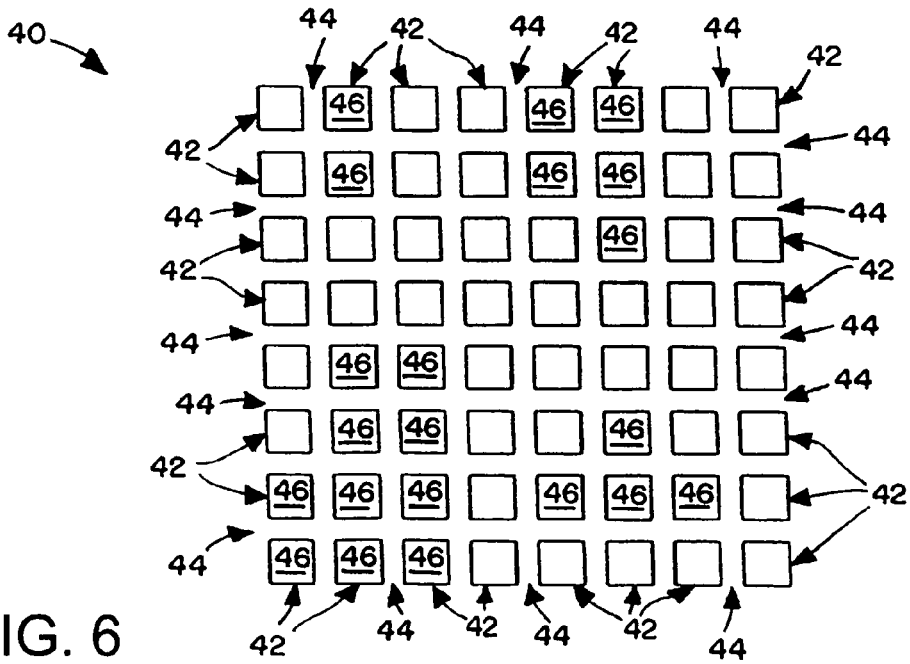
FIG. 6 is a top plan view of another embodiment of a chess game playing array assembly in accordance with the present invention.

Other chess game playing array assemblies may be formed embodying various designs or motifs depending on, for example, the respective size and shape of the three dimensional playing segments, the number of playing segments, the number of playing spaces provided by the respective playing segments, and the particular arrangement of the playing segments including the size and/or shape of the voids, if any, therebetween. Thus, for example, as is shown in FIG. 6, which is a top plan view of a chess game playing array assembly 40, the size and shape of respective three dimensional playing segments 42 may be substantially the same and the arrangement thereof may be such as to form an essentially square shape playing array. Here, as in the playing array assembly of FIGS. 1–5, the spacing or voids 44 between the three dimensional playing segments 42 is substantially uniform throughout the chess game playing array assembly 40 and each playing segment 42 provides a single playing space 46.

Figure 7:
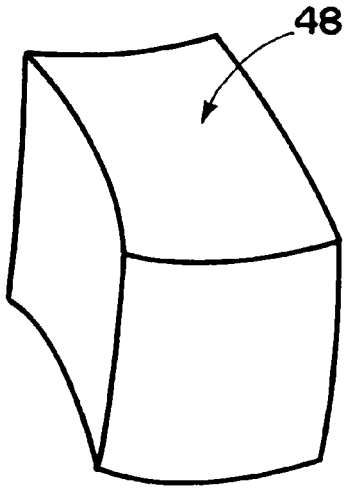
FIG. 7 is a perspective view of one playing segment in accordance with the present invention.
Figure 8:
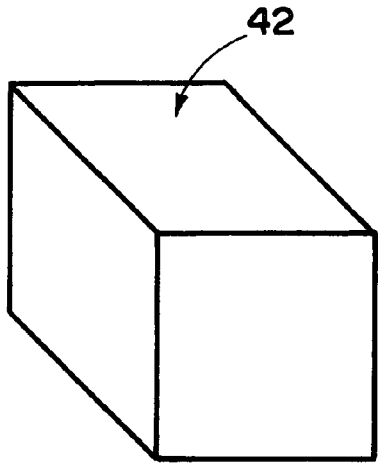
FIG. 8 is a perspective view of another playing segment in accordance with the present invention.
Figure 9:
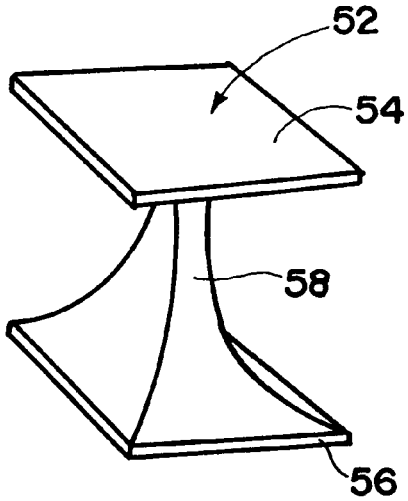
FIG. 9 is a perspective view of another playing segment in accordance with the present invention.
Figure 10:
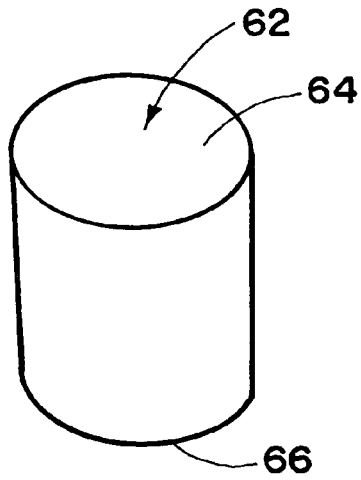
FIG. 10 is a perspective view of another playing segment in accordance with the present invention.

Referring to FIG. 7, there is shown an enlarged view of an exemplary corner three dimensional playing segment 48 of the chess game playing array assembly 10 of FIGS. 1–5. Here, one or more sides of the playing segment 48 may be arcuate to assist in forming the aforementioned arcuate edges of the playing array assembly 10. FIG. 8 shows an enlarged view of a single playing segment of the FIG. 6 playing array assembly 40. Although the playing segments 12, 48 and 42 forming the respective playing array assemblies 10 and 40 are six sided and are substantially rectangular or block shaped, other playing segments may take on different shapes and sizes as desired. For example, in FIG. 9 there is shown a playing segment 52 having a multi-sided top wall 54 and a bottom or base wall 56, and a non-uniform contoured riser or column 58 which connects and extends between the bottom wall 56 and top wall 54. Alternatively, as shown in FIG. 10, a three dimensional playing segment 62 may have an oval or round shape top wall 64 and base wall 66. Of course, a playing array assembly may include a combination of different shaped playing segments (not shown), for example, a combination of playing segments having some oval shaped top walls and some rectangular shaped top walls.

The chess game playing array assembly may be further enhanced by providing the three dimensional playing segments with one or more unique playing surface patterns, or textures. Thus, for example, for the three dimensional playing segments 12 forming the chess game playing array assembly 10 of FIGS. 1–5, the respective playing spaces 16 thereof in the starting positions of the chess game playing pieces (i.e. original positions of the king, queen, bishop, knight, rook, pawn in a traditional chess game) may have a unique pattern, for example, a cobblestone pattern, and the respective playing spaces thereof between the starting positions (i.e., the "battleground" positions) may have another one or more textures or patterns resembling, for example, a mountainous or grassy terrain.

Each three dimensional playing segment may also, or alternatively, include a unique exterior or interior design. For example, as is shown in FIG. 2, the playing segments 12 may resemble buildings (e.g. 71, 72, 73 and 74) of a particular chess enthusiast's favorite city. Alternatively, the three dimensional playing segments 12 may incorporate famous landmarks or even favorite paintings in the form of miniature murals on the side walls of the playing segments (not shown). Also, the chess playing segments 12 may have two different or contrasting colors so that when arranged they provide playing spaces 16 having alternating colors, as is the case, for example, for the traditional chess game playing array.

Figure 11:
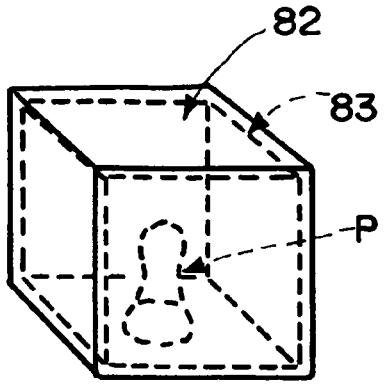
FIG. 11 is a perspective view of another playing segment in accordance with the present invention, showing a playing piece in phantom disposed inside an interior region of the playing segment.
Figure 12:
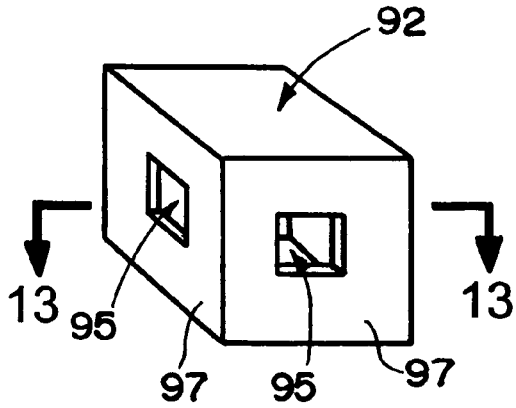
FIG. 12 is a perspective view of another playing segment in accordance with the present invention.
Figure 13:
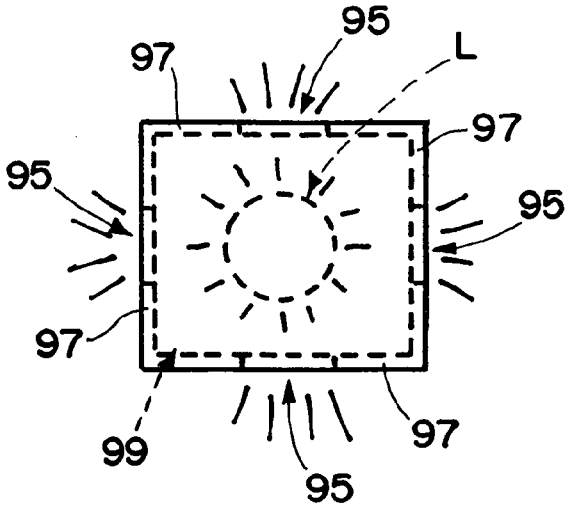
FIG. 13 is a sectional view of the playing segment of FIG. 12 as seen from the line 13—13 in FIG. 12, the playing segment including a lighting element disposed inside an interior region of the playing segment.
Figure 14:
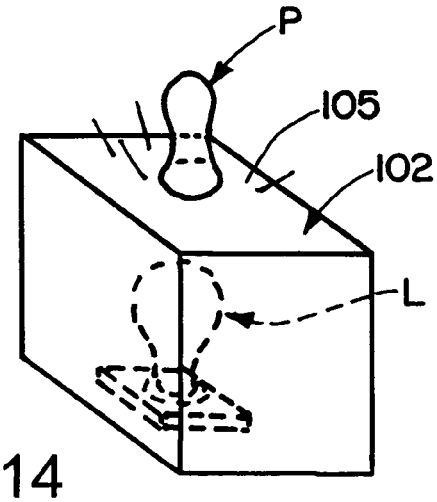
FIG. 14 is a perspective view of another playing segment in accordance with the present invention, the playing segment including a transparent or translucent top wall and a lighting element disposed in an interior region of the playing segment.

The three dimensional playing segments may also or alternatively have interior regions into which further designs and/or accessories may be incorporated. For example, as shown in FIG. 11, a three dimensional playing segment 82 has an interior region 83 used for storing a playing piece P of a particular chess game when the chess game is not in use. Alternatively, a three dimensional playing segment 92, as shown in FIG. 12, may include windows 95 in its side walls 97 and/or decorations or the like in the interior region 83. Further, as shown in FIG. 13, a lighting element L may be inserted into an interior region 99 of the three dimensional playing segment 92 which, when energized, casts light through the windows 95 and into, for example, the voids between the respective three dimensional playing segments. In another three dimensional playing segment 102 shown in FIG. 14, a top wall 105 thereof may be translucent to enable light from a lighting element L to pass therethrough and surround and/or illuminate a playing piece P positioned on the illuminated playing segment 102.

The chess game playing array assembly may be further, or alternatively, enhanced by varying the dimensions and/or size of voids between the respective plurality of three dimensional playing segments. For example, in the illustrated chess game playing array assembly 10 of FIGS. 1–5 the voids 14 between the respective three dimensional playing segments 12 are either arcuate or rectangular in shape and substantially uniform in width across the entire array. In the chess game playing array assembly of FIG. 6 the voids 44 between the respective three dimensional playing segments 42 are rectangular in shape and substantially uniform in width across the entire array. It will be appreciated that widths of voids may vary in size and the voids may also be designed or enhanced to resemble streets, canals or rivers in between the respective playing segments.

Figure 15:
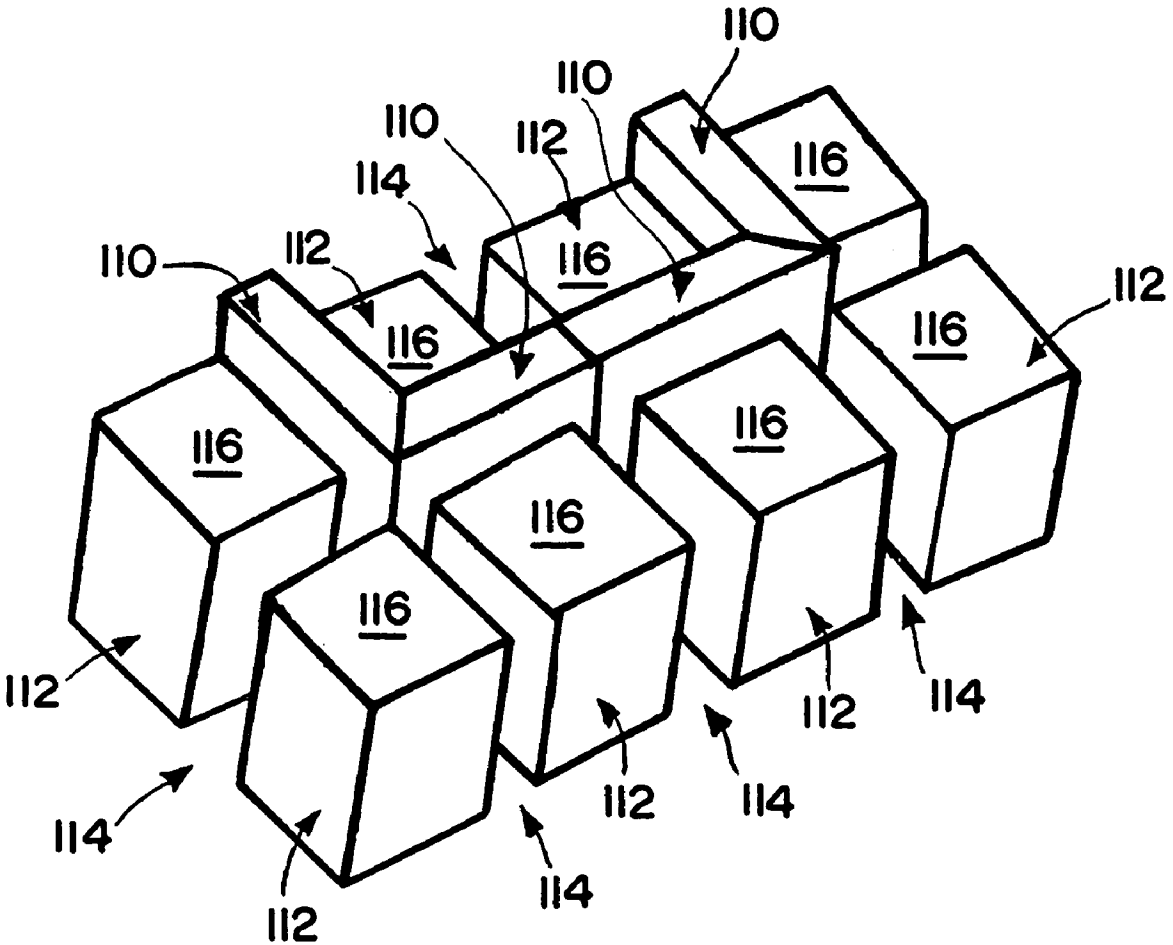
FIG. 15 is a partial perspective view of another chess game playing array assembly in accordance with the present invention.

Alternatively, one or more types of void fillers may be disposed in the voids between the respective playing segments. For example, as shown in FIG. 15, a void filler may comprise an upstanding wall 110 disposed in one or more voids 114 to form, for example, a barrier adjacent to respective playing segments 112. To this end, the three dimensional playing segments 112 of, for example, the king and queen original starting positions, may have upstanding walls 110 which rise above playing spaces 116 of the respective playing segments 112 to form a barrier surrounding the respective king and queen playing pieces. Also, the void fillers may be removable/replaceable in the respective voids between playing segments. Alternatively, or in addition, void fillers may be fixedly connected to, or integrally part of, the respective playing segments.

As was alluded to above, the chess game playing array assembly may also be designed and/or enhanced according to the desired arrangement of the multiple three dimensional playing segments. Thus, the illustrated embodiments include 64 playing segments arranged in an eight row by eight column fashion to form the traditional chess game playing array. Alternative arrangements of the three dimensional playing segments may form a three player (or greater quantity) chess game playing array assembly, a circular chess game playing array assembly, or even a figure eight shaped chess game playing array assembly. The formation of a particular chess game playing array assembly may also be facilitated by the individual construction of the three dimensional playing segments since each playing segment may be uniquely shaped and/or sized. Thus, for example, arcuate shaped three dimensional playing segments may be arranged to form the aforementioned circular shaped chess game playing array assembly.

Figure 16:
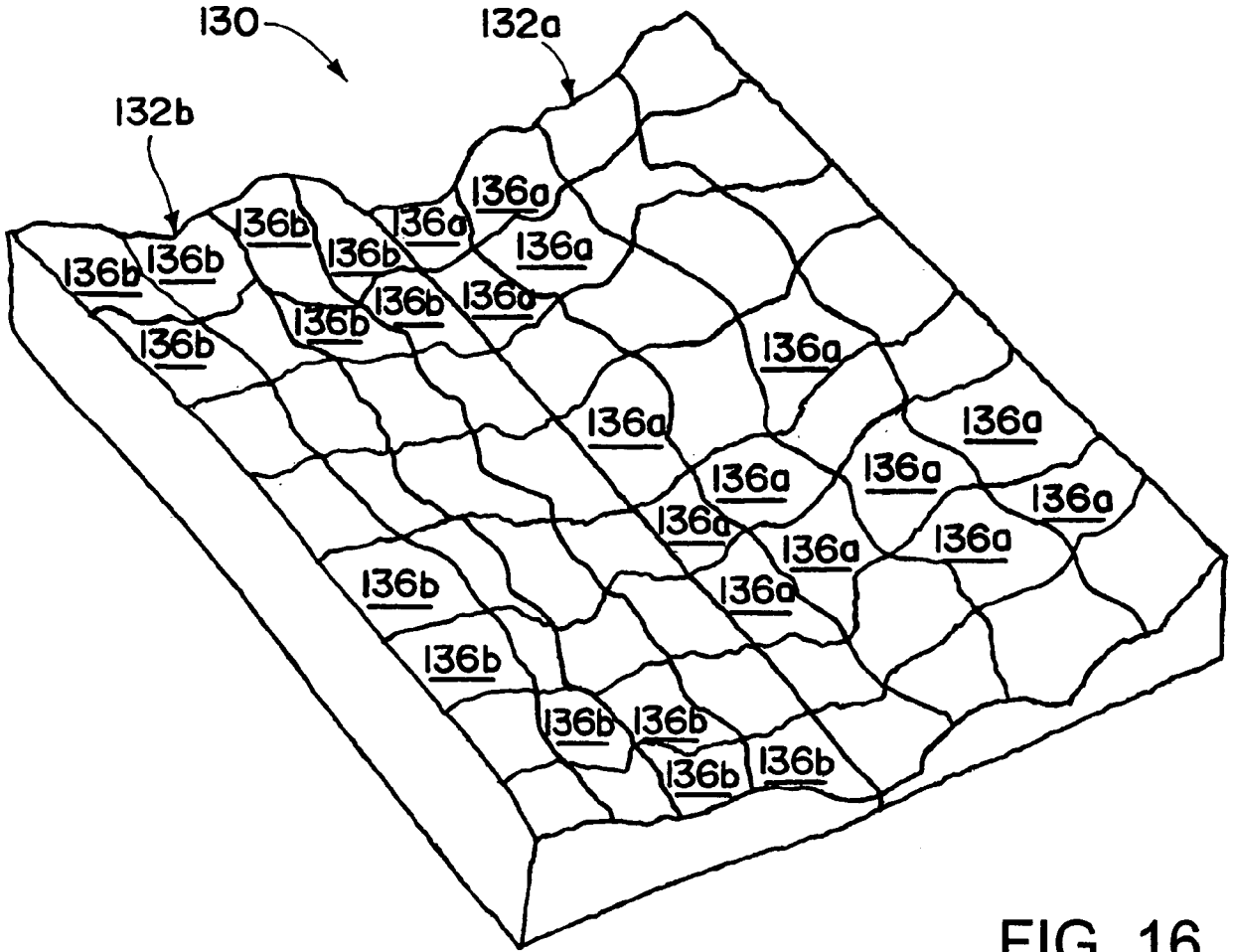
FIG. 16 is a perspective view of another chess game playing array assembly comprising two opposing and abutting playing segments.

Referring now to FIG. 16, there is shown a chess game playing array assembly 130 embodying two opposing and abutting three dimensional playing segments 132*a* and 132*b*. In this embodiment, there is no void spacing the differing playing segments 132*a* and 132*b* apart from one another. Each playing segment 132*a* and 132*b* forms one half (i.e., an array of 32 playing spaces 136*a* and 136*b*, respectively) of a traditional chess game playing array. Although, the illustrated playing segments 132*a* and 132*b* include individual landscape terrains, the playing segments may be graduated or sloped to provide a stadium-like configuration, as illustrated in FIGS. 1–5. For example, each playing segment 132*a* and 132*b* may comprise a sports motif characterized by, for example, a chess enthusiast's favorite football team or baseball team. Thus, it will be appreciated that the individual three dimensional playing segments 132*a* and 132*b* enable multiple theaters or motifs to be constructed and then paired up against an opposing theater or motif.

Figure 17:
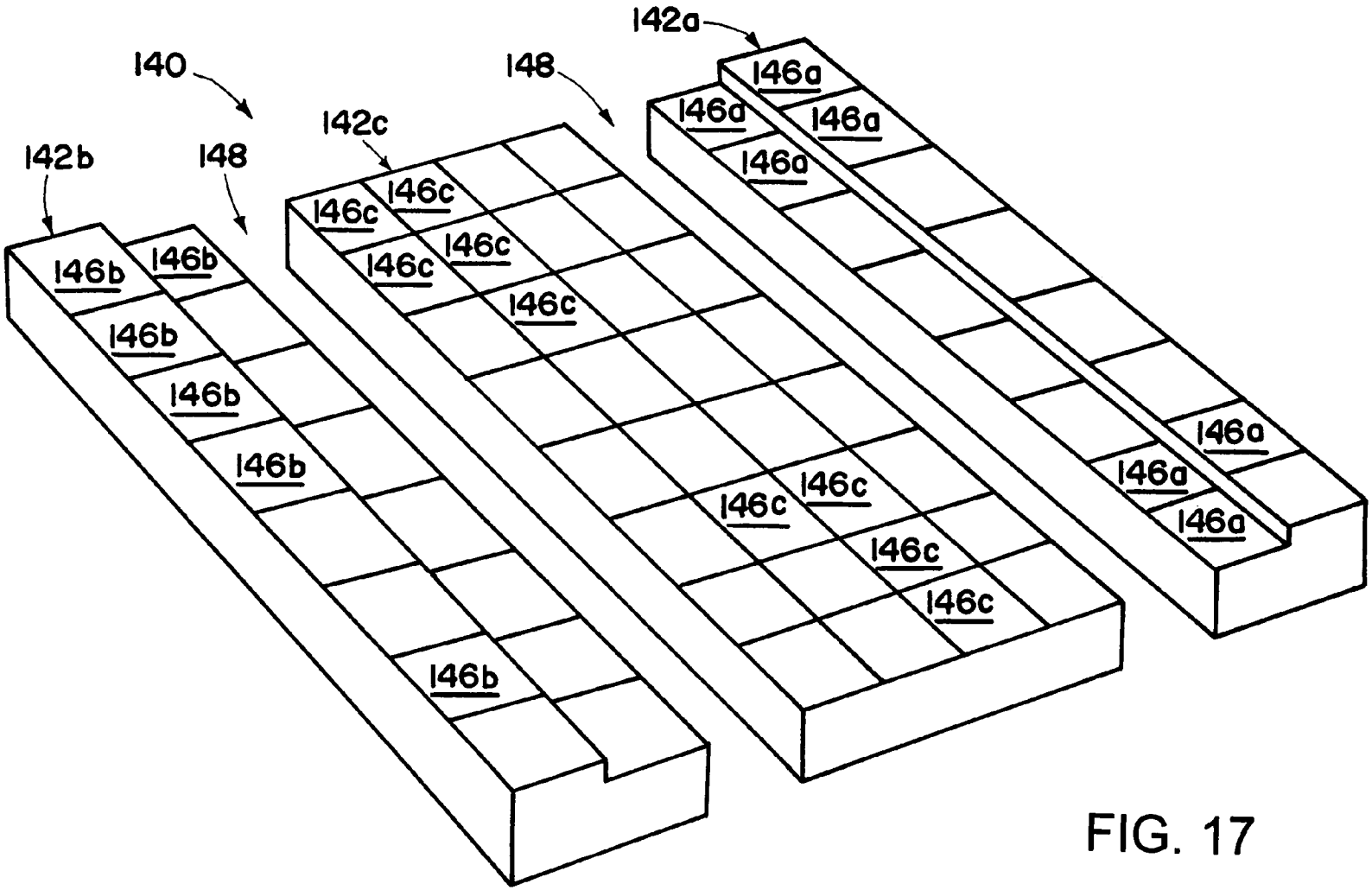
FIG. 17 is a perspective view of another chess game playing array assembly comprising three playing segments.

In accordance with the present invention, there may be any number of multiple three dimensional playing segments so long as the arrangement thereof forms playing spaces on which a game of chess, traditional or otherwise, may be played. Thus, for example, as is shown in FIG. 17, a chess game playing array assembly 140 may include three dimensional playing segments 142*a*, 142*b*, 142*c*, wherein a first playing segment 142*a* forms the original starting playing spaces 146*a* for a first player, a second playing segment 142*b* forms the original starting playing spaces 146*b* for a second player and a third playing segment 142*c* forms the intermediate, or battleground, playing spaces 146*c* between the respective original starting playing spaces 146*a* and 146*b* of the respective first and second opposing playing segments 142*a* and 142*b*. Voids 148 are shown disposed between the respective playing segments 142*a*, 142*b* and 142*c* although it will be appreciated that the playing segments 142*a*, 142*b* and 142*c* may be disposed in abutting relation to one another (i.e., wherein playing segment 142*a* abuts playing segment 142*c* on one side thereof and playing segment 142*b* abuts playing segment 142*c* on the opposing side thereof).

Figure 18:
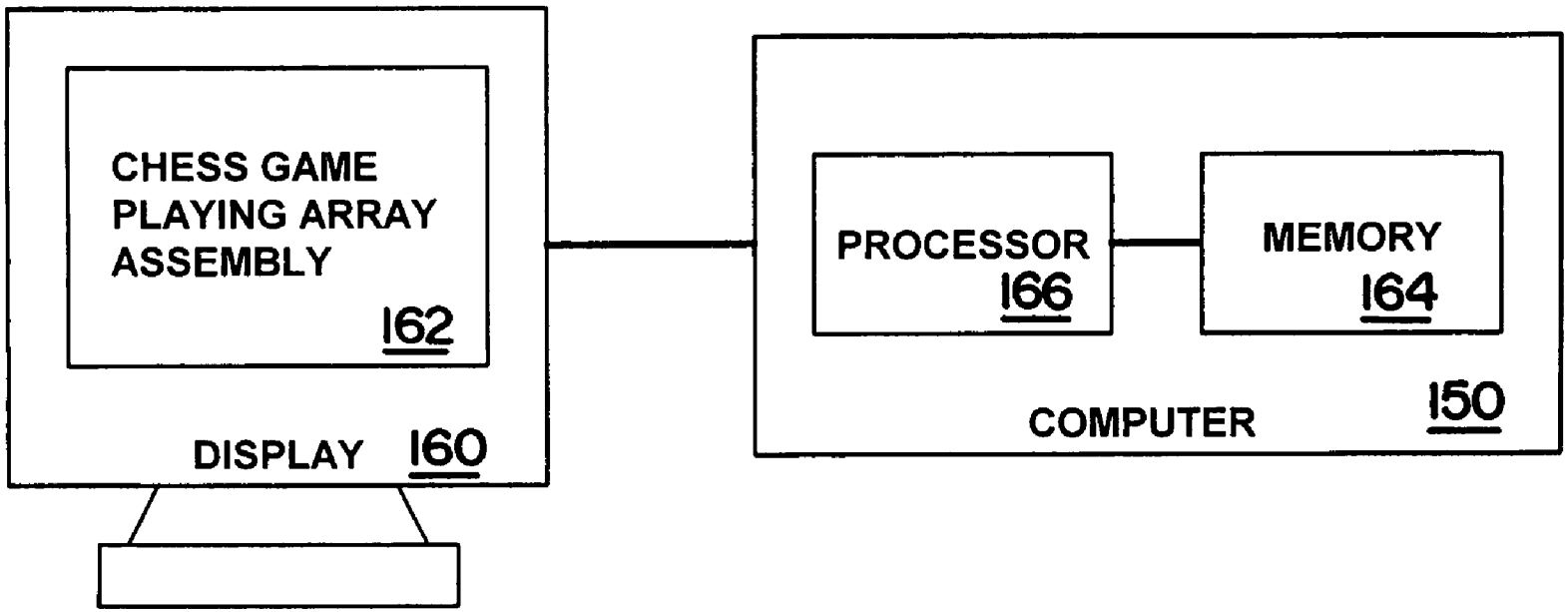
FIG. 18 is a block diagram of a display and computer in accordance with the present invention embodying a chess game playing array assembly.

Referring now to FIG. 18, the present invention may also be embodied on a computer 150 as a graphical user interface displayed on a display device 160 such as a computer screen, CRT, LCD or the like. Also, in accordance with the present invention, the chess game playing array assembly 162 may be embodied as logic stored in a memory 164, the logic being capable of being processed by a processor 166, to generate a displayed image of the chess game playing array assembly 162 on a display 160. In addition, the design of the multiple three dimensional playing segments and/or the arrangement thereof may be assisted by a computer program, for example, a CAD or graphics program. The program may be adapted to receive various design parameter inputs, for example, the respective size and shape of the three dimensional playing segments, the number of playing segments, the number of playing spaces provided by the respective playing segments, and the particular arrangement of the playing segments including the size and/or shape of the voids therebetween. In this way, a designer may vary each parameter until a desirable chess game playing array assembly is formed.

Although the invention has been shown and described with respect to certain exemplary embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A chess game playing array assembly consisting of:

a total of two opposing playing segments disposed relative to one another to define an array of playing spaces on which chess game playing pieces are selectively placed when a game of chess is being played;

wherein the two opposing playing segments are sloped toward each other, and wherein one of the playing segments includes a first motif having a first landscape terrain pattern and the other playing segment includes a second motif having a second landscape terrain pattern different from and not a repeat pattern or a reverse pattern of the first landscape terrain pattern of the first motif; and wherein the two opposing playing segments include respective topographic geometries that are different from one another and are not a repeat pattern or a reverse repeat pattern of one another.

2. A chess game playing array assembly as set forth in claim 1, wherein each of the two playing segments defines a four row by eight column array of playing spaces such that when disposed relative to one another collectively an eight row by eight column array of playing spaces is formed.

3. A chess game playing array assembly as set forth in claim 1, wherein the two playing segments are disposed in opposing abutting relation.

4. A chess game playing array assembly consisting of:

a total of three three-dimensional playing segments disposed relative to one another to define an array of playing spaces on which chess game playing pieces are selectively placed when a game of chess is being played;

two of the playing segments including respective first and second playing motifs, the first playing motif being different than the second playing motif and not a repeat pattern or a reverse repeat pattern of the second playing motif, and first and second arrays of playing spaces, and the third playing segment being disposed between the first and second playing segments and including a third playing motif different from that of the first two playing motifs that is not a repeat pattern or a reverse repeat pattern of the first two playing motifs, and a third array of playing spaces, the three arrays of playing spaces together forming an eight row by eight column array of playing spaces.

5. A chess game playing array assembly as set forth in claim 4, wherein the first two playing segments are sloped toward opposite ends of the third playing segment.

6. A chess game playing array assembly comprising:

a plurality of three-dimensional playing segments that are selectively positioned relative to one another to define a rectilinear or non-rectilinear array of playing spaces on which chess game playing pieces are selectively placed when a game of chess is being played;

wherein the plurality of three-dimensional playing segments are spaced apart by one or more rectilinear or non-rectilinear voids, and one or more void fillers disposed in the respective one or more voids, wherein the one or more void fillers comprises an upstanding wall rising above adjacently disposed playing segments for separating the adjacently disposed playing segments, and wherein at least one of the plurality of three-dimensional playing segments includes a bottom wall, a top wall and a column which connects and extends between the bottom wall and top wall, the column having a smaller cross sectional area than either of the bottom wall and the top wall.

7. A chess game playing array assembly comprising:

a plurality of three-dimensional playing segments that are selectively positioned relative to one another to define a rectilinear or non-rectilinear array of playing spaces on which chess game playing pieces are selectively placed when a game of chess is being played;

wherein the plurality of three-dimensional playing segments are spaced apart by one or more rectilinear or non-rectilinear voids, and one or more void fillers disposed in the respective one or more voids, wherein the one or more void fillers comprises an upstanding wall rising above adjacently disposed playing segments for separating the adjacently disposed playing segments, wherein at least one of the plurality of three-dimensional playing segments has an interior region that is accessible from the exterior of the one playing segment, and wherein at least one of the playing pieces is stored in the interior region of the one playing segment when the chess game is not in use.

8. A chess game playing array assembly comprising:

a plurality of three-dimensional playing segments that are selectively positioned relative to one another to define a rectilinear or non-rectilinear array of playing spaces on which chess game playing pieces are selectively placed when a game of chess is being played;

wherein the plurality of three-dimensional playing segments are spaced apart by one or more rectilinear or non-rectilinear voids, and one or more void fillers disposed in the respective one or more voids, wherein the one or more void fillers comprises an upstanding wall rising above adjacently disposed playing segments for separating the adjacently disposed playing segments, wherein at least one of the plurality of three-dimensional playing segments has an interior region that is accessible from the exterior of the one playing segment, and wherein the interior region houses a lighting element, and the one playing segment has at least one window in at least one side wall through which light from the lighting element is cast into at least one of the voids between the respective playing segments.

9. A chess game playing array assembly comprising:

a plurality of three-dimensional playing segments that are selectively positioned relative to one another to define a rectilinear or non-rectilinear array of playing spaces on which chess game playing pieces are selectively placed when a game of chess is being played;

wherein the plurality of three-dimensional playing segments are spaced apart by one or more rectilinear or non-rectilinear voids, and one or more void fillers disposed in the respective one or more voids, wherein the one or more void fillers comprises an upstanding wall rising above adjacently disposed playing segments for separating the adjacently disposed playing segments, and wherein the plurality of three-dimensional playing segments comprise first and second opposing playing segments, each playing segment defining a four row by eight column array of playing spaces such that when disposed relative to one another collectively an eight row by eight column array of playing spaces is formed, wherein the first playing segment includes a different motif than that of the second playing segment that is not a repeat pattern or a reverse repeat pattern of the second playing motif.

* * * * *